US010861384B1

(12) United States Patent
Yang et al.

(10) Patent No.: US 10,861,384 B1
(45) Date of Patent: Dec. 8, 2020

(54) METHOD OF CONTROLLING IMAGE DATA AND RELATED IMAGE CONTROL SYSTEM

(71) Applicant: NOVATEK Microelectronics Corp., Hsin-Chu (TW)

(72) Inventors: Chih-Yuan Yang, Hsinchu County (TW); Feng-Ting Pai, Hsinchu (TW)

(73) Assignee: NOVATEK Microelectronics Corp., Hsin-Chu (TW)

( * ) Notice: Subject to any disclaimer, the term of this patent is extended or adjusted under 35 U.S.C. 154(b) by 0 days.

(21) Appl. No.: 16/453,971

(22) Filed: Jun. 26, 2019

(51) Int. Cl.
*G09G 3/3208* (2016.01)

(52) U.S. Cl.
CPC ..... *G09G 3/3208* (2013.01); *G09G 2320/046* (2013.01); *G09G 2320/066* (2013.01); *G09G 2320/0626* (2013.01); *G09G 2320/0673* (2013.01); *G09G 2360/144* (2013.01); *G09G 2360/145* (2013.01)

(58) Field of Classification Search
USPC ..... 345/207
See application file for complete search history.

(56) References Cited

U.S. PATENT DOCUMENTS

2006/0268180 A1* 11/2006 Chou ..... H04N 5/58 348/673
2007/0126757 A1* 6/2007 Itoh ..... G09G 3/3258 345/690
2008/0037867 A1* 2/2008 Lee ..... H04N 9/68 382/168
2008/0240586 A1* 10/2008 Iizuka ..... H04N 9/8227 382/232
2010/0007665 A1* 1/2010 Smith ..... G06T 13/40 345/473
2010/0328535 A1* 12/2010 Okui ..... G09G 3/3406 348/578
2011/0018892 A1* 1/2011 Otawara ..... H04N 9/77 345/589
2011/0187754 A1* 8/2011 Yoo ..... G09G 5/10 345/690
2015/0029222 A1* 1/2015 Hofmann ..... G06K 9/6202 345/633
2015/0103106 A1* 4/2015 Chaji ..... G09G 3/3225 345/690
2018/0174516 A1* 6/2018 Kim ..... H01L 51/5203
2019/0114965 A1* 4/2019 Lim ..... H01L 51/50

* cited by examiner

*Primary Examiner* — Chineyere D Wills-Burns
(74) *Attorney, Agent, or Firm* — Winston Hsu

(57) ABSTRACT

A method of controlling image data includes the steps of: receiving an image frame; generating an image data distribution of the image frame; and controlling a parameter for displaying the image frame according to the image data distribution.

18 Claims, 13 Drawing Sheets

Too dark

Well balanced

Too bright

Histogram

2-D feature profile

| | | | | | | | |
|---|---|---|---|---|---|---|---|
| 1 | 0 | 0 | 0 | 0 | 0 | 0 | 0 |
| 1 | 0 | 0 | 0 | 0 | 0 | 0 | 0 |
| 1 | 0 | 0 | 0 | 0 | 0 | 0 | 0 |
| 1 | 1 | 0 | 0 | 0 | 0 | 0 | 0 |

1-D feature profile

Profile[8] = {0xf, 0x1, 0x0, 0x0, 0x0, 0x0, 0x0, 0x0}

METHOD OF CONTROLLING IMAGE DATA AND RELATED IMAGE CONTROL SYSTEM

BACKGROUND OF THE INVENTION

1. Field of the Invention

The present invention relates to a method of controlling image data and a related image control system, and more particularly, to a method of controlling image data and a related image control system for an organic light-emitting diode (OLED) panel.

2. Description of the Prior Art

An organic light-emitting diode (OLED) is a light-emitting diode (LED) in which the emissive electroluminescent layer is a film of organic compound, where the organic compound can emit light in response to an electric current. OLEDs are widely used in displays of electronic devices such as television screens, computer monitors, portable systems such as mobile phones, handheld game consoles and personal digital assistants (PDAs). To control a general OLED panel to display a video, a driver circuit (e.g., a driver IC) is usually implemented to drive the OLED panel to display. An image source of a host may obtain or generate image data and then send the image data to the driver circuit. The driver circuit then forwards the image data to the OLED panel. In order to enhance the image quality and achieve other purposes such as cost reduction, the driver circuit is also capable of processing the image data to be adapted to image features, panel features, and/or ambient brightness.

In general, the driver circuit may detect the image content and then perform image processing based on the image content. For example, the average luminance of image data may be determined. However, the average value cannot show the entire image content and image feature. An example is illustrated in FIGS. 1A and 1B. FIG. 1A shows a uniformly gray image with luminance value Y=128. FIG. 1B shows an image showing two parts, where the black image with luminance value Y=0 is in the left half part and the white image with luminance value Y=255 is in the right half part. The images shown in FIGS. 1A and 1B may have identical average luminance, but these two images have evidently different features. In addition, if the average luminance is obtained by segmenting an image frame into several blocks and calculating the average in each block. The number of blocks may not be determined easily and the final average operation between blocks requires more computation resource and circuit area.

Thus, there is a need to provide a more effective method for determining image content, to realize satisfactory image processing.

SUMMARY OF THE INVENTION

It is therefore an objective of the present invention to provide a method of controlling image data and a related image control system, which are capable of controlling and processing image data to achieve higher image quality, lower power consumption, and higher product lifespan of panel.

An embodiment of the present invention discloses a method of controlling image data. The method comprises the steps of: receiving an image frame; generating an image data distribution of the image frame; and controlling a parameter for displaying the image frame according to the image data distribution.

Another embodiment of the present invention discloses an image control system, which comprises an image detector and an image processor. The image detector is configured to receive an image frame and generate an image data distribution of the image frame. The image processor, coupled to the image detector, is configured to control a parameter for displaying the image frame according to the image data distribution.

These and other objectives of the present invention will no doubt become obvious to those of ordinary skill in the art after reading the following detailed description of the preferred embodiment that is illustrated in the various figures and drawings.

DETAILED DESCRIPTION

Figure 1A:
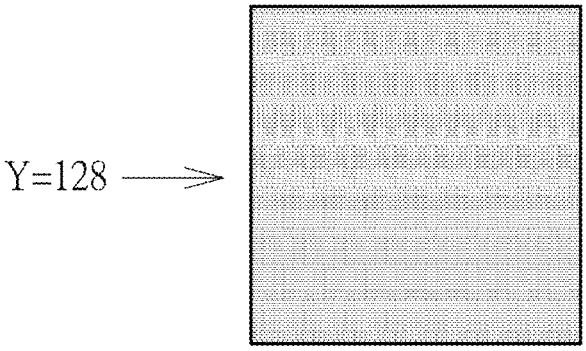
FIG. 1A PRIOR ART
FIGS. 1A and 1B are schematic diagrams of image content.
Figure 1B:
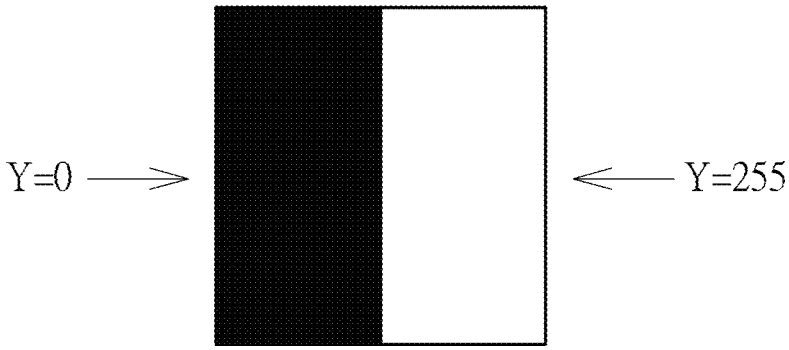
FIG. 1B PRIOR ART
Figure 2A:
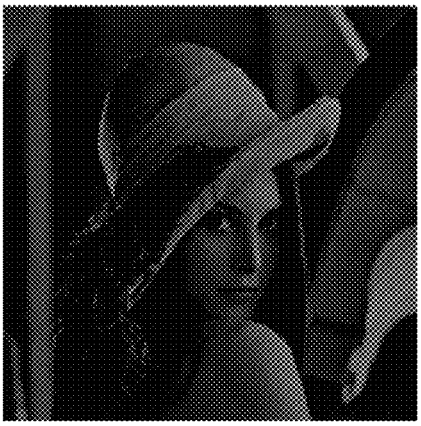
FIGS. 2A, 2B and 2C illustrate different image features and related histogram distribution of luminance.
Figure 2A:
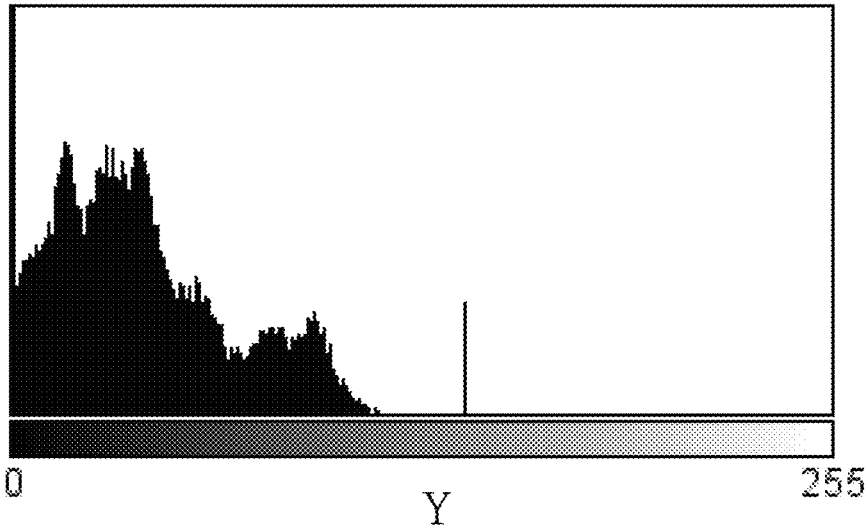
Figure 2B:
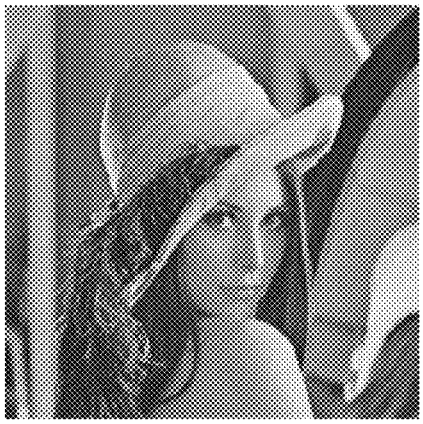
Figure 2B:
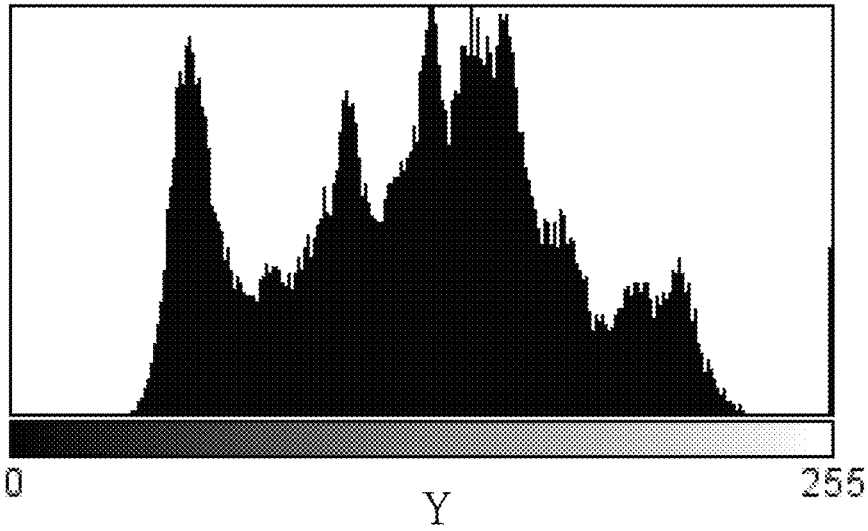
Figure 2C:
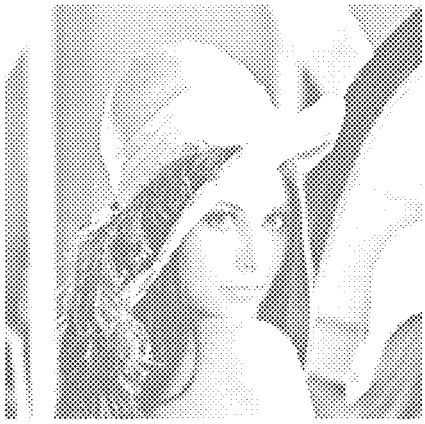
Figure 2C:
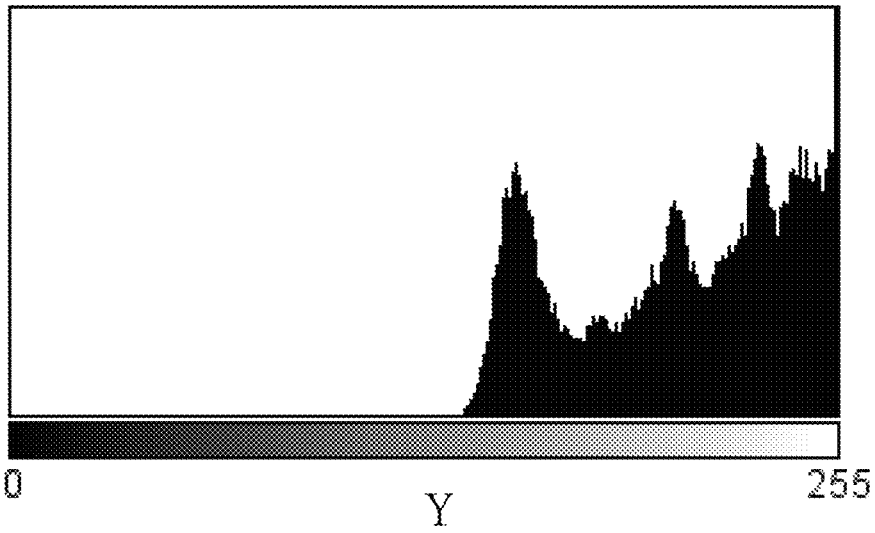

As mentioned above, the average luminance of image data cannot reflect the entire image content, and thus may not achieve preferable image processing based on the average luminance. In order to solve this problem, the present invention provides a novel method of obtaining the image feature. In an embodiment, a histogram distribution of luminance of pixel data in an image frame may be obtained, to determine the content of the image frame or determine which type the image frame belongs to, such as a brighter image or a darker image. For example, please refer to FIGS. 2A, 2B and 2C, which illustrate different image features and related histogram distribution of luminance. In the histogram, the horizontal axis stands for luminance denoted by digital values between 0 and 255, and the vertical axis stands for the statistic result of the number of pixels with each luminance. In detail, FIG. 2A illustrates a dark image, where the histogram shows that most pixel data are concentrated on lower luminance values. FIG. 2C illustrates a bright image, where the histogram shows that most pixel data are concentrated on higher luminance values. FIG. 2B illustrates a normal and balanced brightness, where the pixel data are distributed uniformly in the luminance range between 0 and 255. Therefore, the driver circuit may perform parameter control or parameter adjustment on the image data according to the detected feature of image frame. For example, larger brightness improvement is required for the darker image such as an image frame having image data distribution as similar to that shown in FIG. 2A.

Figure 3:
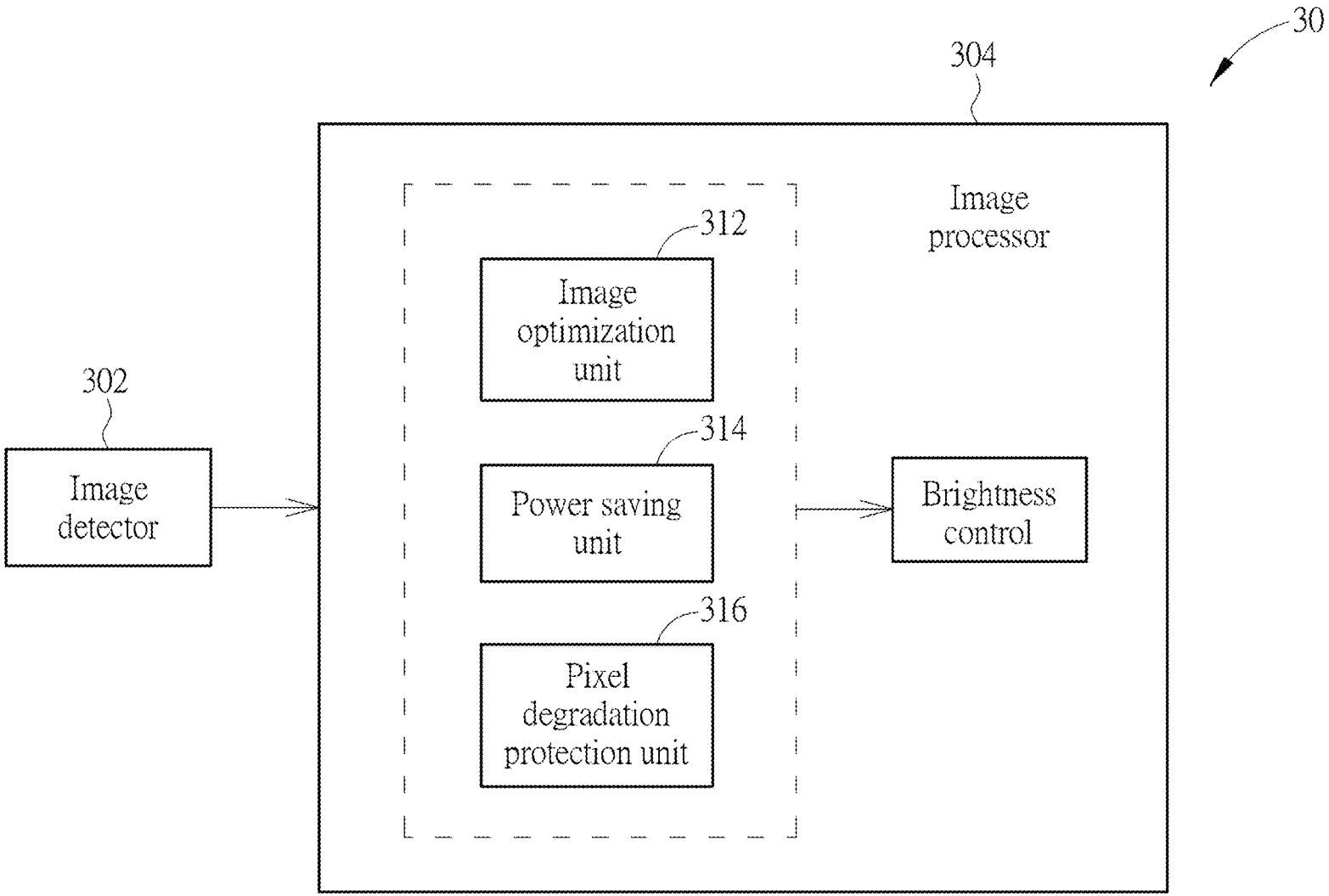
FIG. 3 is a schematic diagram of an image control system according to an embodiment of the present invention.

Please refer to FIG. 3, which is a schematic diagram of an image control system 30 according to an embodiment of the present invention. The image control system 30 may be implemented in a driver circuit or a driver IC for forwarding image data to a panel and driving the panel. As shown in FIG. 3, the image control system 30 includes an image detector 302 and an image processor 304. The image detector 302 is configured to receive an image frame and generate an image data distribution of the image frame. The image data distribution may be in the form of histogram distribution as described above. Subsequently, the image processor 304 may control a parameter for displaying the image frame according to the image data distribution obtained from the image detector 302.

In detail, the image processor 304 may perform image processing in various aspects. In an embodiment, the image processor 304 includes an image optimization unit 312, a power saving unit 314 and a pixel degradation protection unit 316, as shown in FIG. 3. The image optimization unit 312 is configured to perform luminance adjustment, contrast adjustment, and/or color offset on image data to optimize the image quality. The power saving unit 314 is configured to compensate image data to realize power saving. The pixel degradation protection unit 316 is configured to adjust image data to prevent or mitigate degradation of the panel. For example, the burn-in problem is a common issue for the organic light-emitting diode (OLED) panels. The pixel degradation protection unit 316 may adjust the brightness of output image to reduce panel degradation. Based on processing of the image processor 304, the brightness of output image may be well controlled to achieve various purposes.

Figure 4:
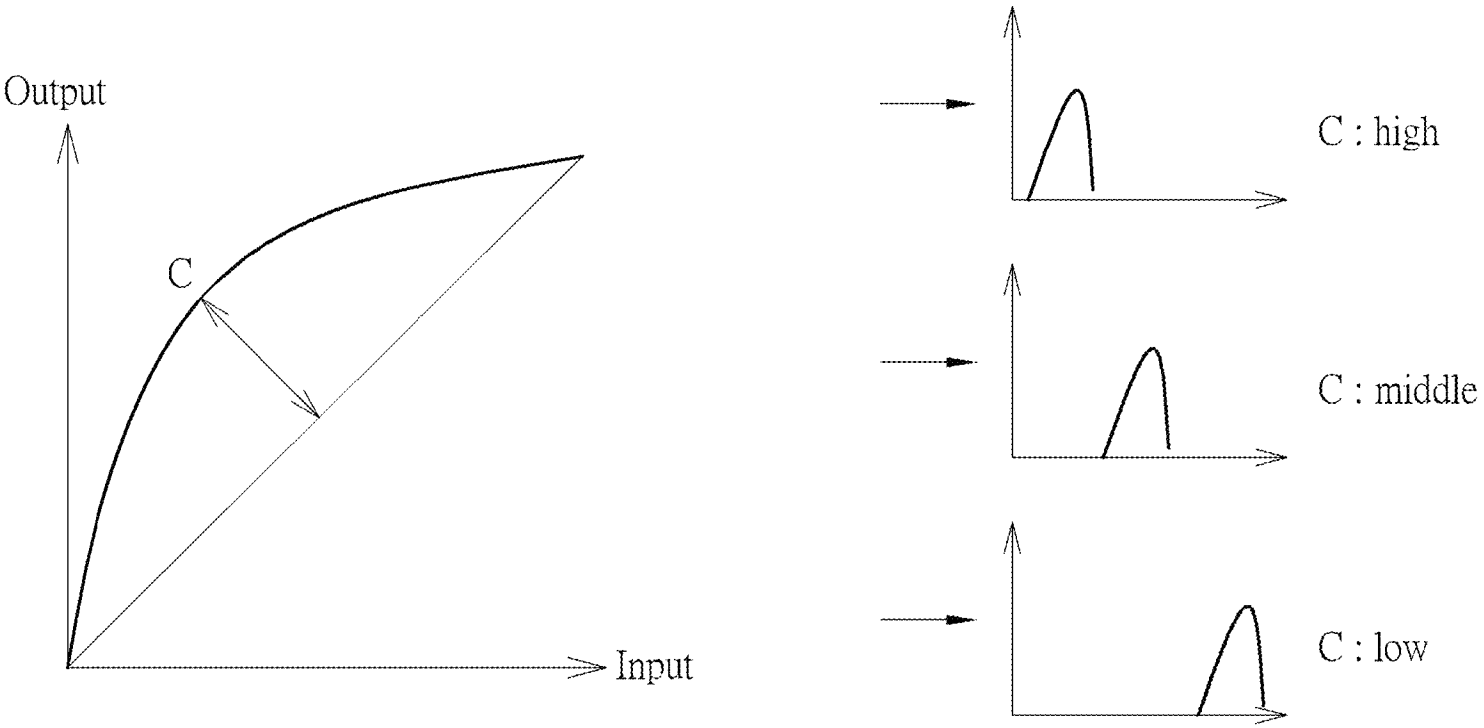
FIG. 4 is a schematic diagram of image optimization according to an embodiment of the present invention.

Please refer to FIG. 4, which is a schematic diagram of image optimization according to an embodiment of the present invention. FIG. 4 illustrates the relations between the output luminance and the input luminance, where the output luminance may be generated by a luminance enhancement module in the image optimization unit 312. As shown in FIG. 4, an oblique straight line refers to output equal to input, i.e., without luminance enhancement. The curve C refers to a luminance enhancement curve, which is composed of multiple luminance enhancement parameters based on input luminance values, to represent the degree of luminance enhancement. If the luminance enhancement curve C has higher curvature and is further away from the straight line, higher degree of luminance enhancement is provided. When the histogram distribution indicates lower luminance in the input image, the luminance enhancement curve C may be adjusted to be higher, to provide stronger luminance enhancement on the input image. When the histogram distribution indicates higher luminance in the input image, the luminance enhancement curve C may be adjusted to be lower, to provide weaker luminance enhancement on the input image. When the histogram distribution indicates medium luminance in the input image, the luminance enhancement curve C may be adjusted have middle and adequate values. Note that the luminance enhancement curve C may further be adjusted based on other factors, e.g., based on a brightness control signal received from a user, and/or based on brightness detection of ambient light. For example, in the outdoors with high ambient light intensity, the luminance enhancement curve C may be adjusted to a higher value, allowing the user to clearly watch the image under a high brightness environment.

Figure 5:
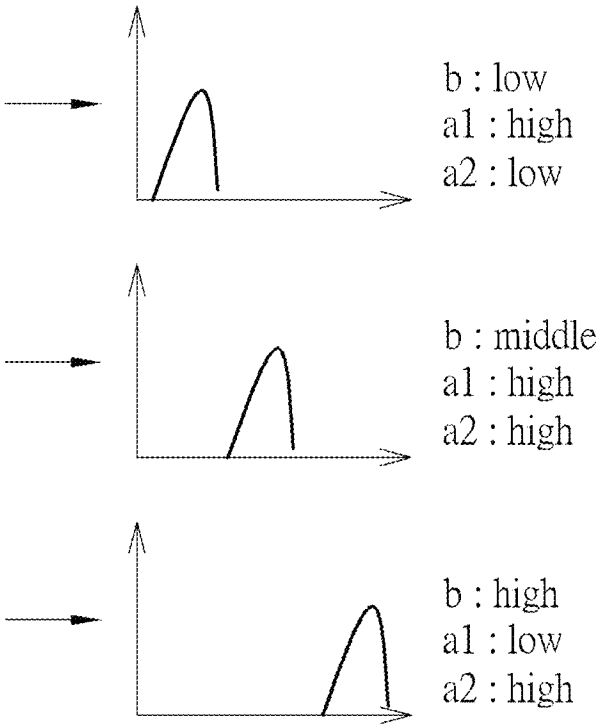
FIG. 5 is a schematic diagram of image optimization according to another embodiment of the present invention.
Figure 5:
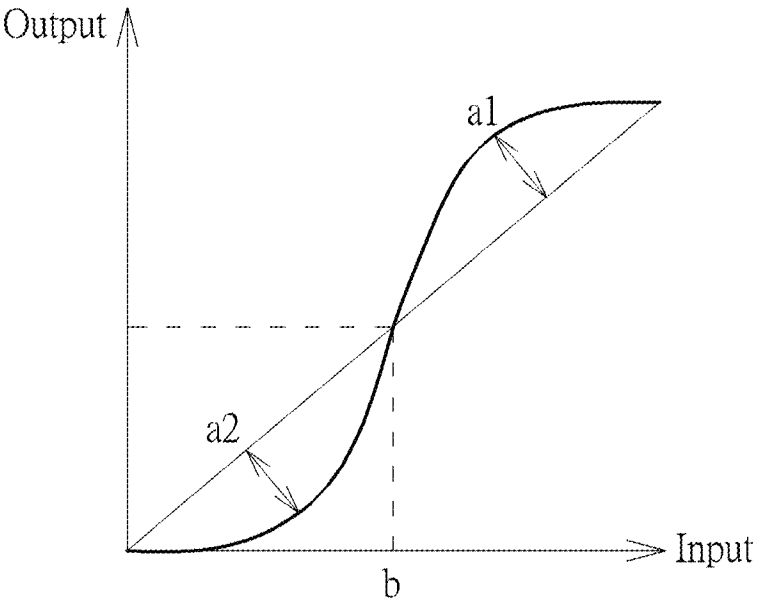

Please refer to FIG. 5, which is a schematic diagram of image optimization according to another embodiment of the present invention. FIG. 5 illustrates the relations between the output luminance and the input luminance, where the output luminance may be generated by a contrast adjustment module in the image optimization unit 312. As shown in FIG. 5, an oblique straight line refers to output equal to input, i.e., without contrast adjustment. The parameters a1 and a2 refer to contrast adjustment parameters, which adjust the luminance for high input values and low input values, respectively. More specifically, the parameter a1 increases the luminance for high input values and the parameter a2 decreases the luminance for low input values, so as to enhance the contrast. The parameter b refers to a threshold separating high luminance values and low luminance values. If the parameters a1 and a2 have higher values and generate curves further away from the straight line, a higher level of contrast enhancement is provided. As shown in FIG. 5, when the histogram distribution indicates lower luminance in the input image, the parameter a1 may be higher, the parameter a2 may be lower, and the parameter b may be lower. When the histogram distribution indicates higher luminance in the input image, the parameter a1 may be lower, the parameter a2 may be higher, and the parameter b may be higher. When the histogram distribution indicates medium luminance in the input image, the parameters a1 and a2 may be higher, and the parameter b may have a middle value. The above configurations provide optimal contrast adjustment based on the input image features, and more particularly, based on the luminance distribution of the input image. In an embodiment, the contrast adjustment may be integrated with luminance enhancement to generate the output luminance value having optimal brightness and contrast.

In addition to the processing of luminance compensation and contrast adjustment in the luminance domain, the image optimization unit 312 may also provide color enhancement or offset compensation in a color domain. Color enhancement may improve the visual effects of the image. In an embodiment, if the input image is dark, the image may suffer from noise interference much more. Therefore, it is preferable to provide an offset in color domain for a darker image.

Figure 6:
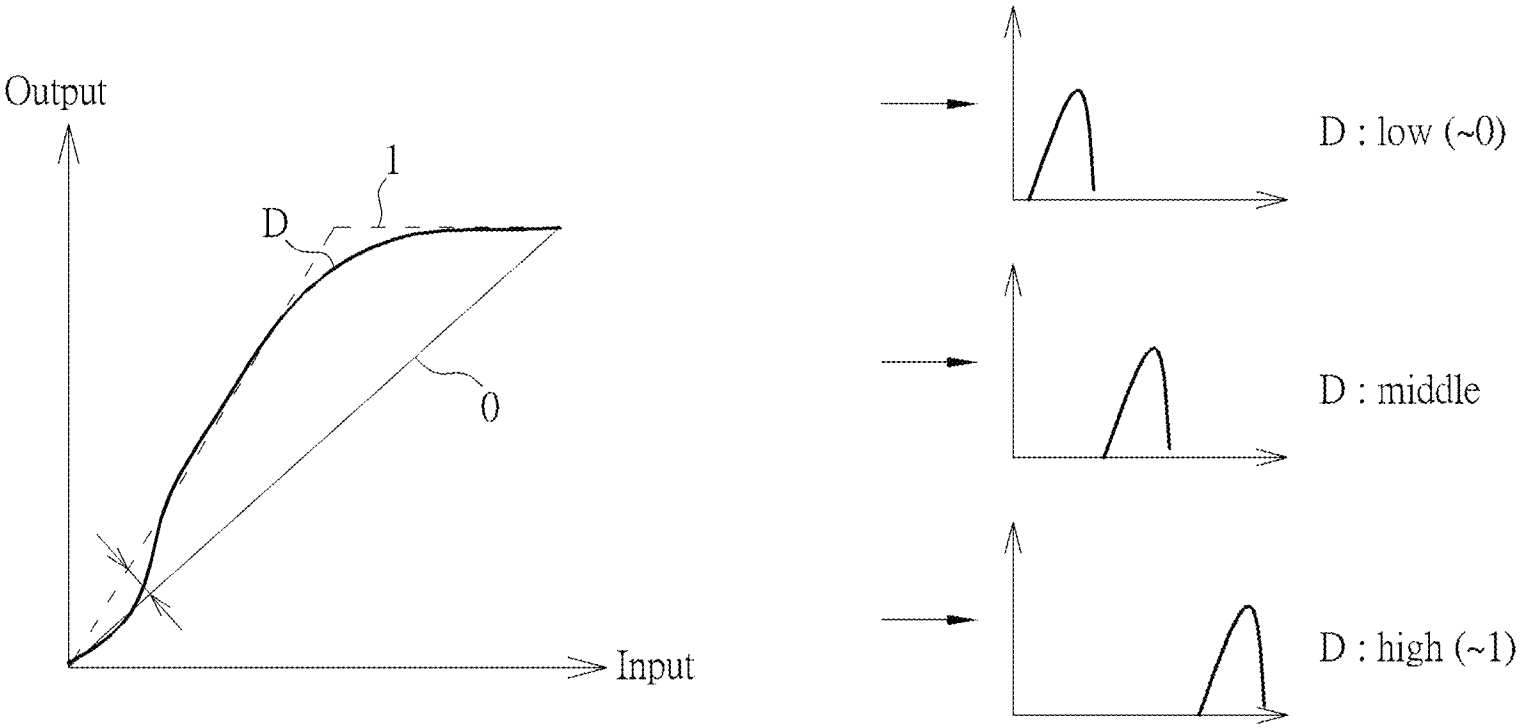
FIG. 6 is a schematic diagram of image optimization according to a further embodiment of the present invention.

Please refer to FIG. 6, which is a schematic diagram of image optimization according to a further embodiment of the present invention. FIG. 6 illustrates the relations between the output chroma and the input chroma, where the output chroma may be generated by a color enhancement module in the image optimization unit 312. As shown in FIG. 6, an oblique solid straight line refers to output equal to input, i.e., without color enhancement. A dashed line refers to full degree of color enhancement. The curve D refers to a color enhancement curve, which is composed of multiple color enhancement parameters based on input chroma values, to represent the degree of color enhancement. In general, the color enhancement curve D falls between the oblique solid line and the dashed line. If the color enhancement curve D is further away from the solid straight line, a higher degree of color enhancement is provided.

Please note that the color enhancement curve D may not be a pure curve. In an embodiment, the degree of color enhancement may be normalized as a parameter between 0 and 1, where 1 stands for full enhancement as the dashed line and 0 stands for no enhancement as the solid straight line. As shown in FIG. 6, the color enhancement curve D has offset for lower brightness pixels and higher brightness pixels. Since the lower brightness pixels suffer from noise interference more severely, the color enhancement degree may be reduced for the lower brightness pixels, in order to suppress noise magnitude for darker images. For the higher brightness pixels, the enhancement degree is saturated to reach the maximum chroma value if the color enhancement curve D follows the dashed line. Therefore, a color offset is provided for higher brightness pixels to allow the output image in brighter area appearing to be natural.

Based on the histogram distribution of luminance obtained from the image detector 302, the color enhancement module may perform color enhancement and adjustment in a proper manner. In this embodiment, when the histogram distribution indicates lower luminance in the input image, the parameter of color enhancement may be low or close to 0, and thus the color enhancement curve D may be adjusted to be closer to the solid straight line. When the histogram distribution indicates higher luminance in the input image, the parameter of color enhancement may be high or close to 1, and thus the color enhancement curve D may be adjusted to be closer to the dashed line. When the histogram distribution indicates medium luminance in the input image, the parameter of color enhancement may be a middle value, and thus the color enhancement curve D may be adjusted to be an adequate curve.

In order to realize the abovementioned luminance enhancement and color enhancement control, the input image data in RGB domain may be pre-processed and converted into another color space domain such as HSV domain or YCrCb domain. For example, in the YCrCb domain, the luminance value and the chroma value are separated and may easily be extracted from the image data, so that the luminance and chroma may be controlled and enhanced respectively.

In another aspect, for power saving purpose, the power saving unit 314 may control or adjust the luminance values according to the histogram distribution of luminance of the input image frame. In general, the luminance control may be realized by controlling image data mapping and emission duty. As for the emission duty, the image brightness may be adjusted by controlling the emission duty for displaying the image frame on the panel. The emission duty refers to the ratio of emission time in a data cycle, and may be implemented based on the type of panel. For example, the emission time may be the turned-on time of OLED devices for an OLED panel, or the turned-on time of backlight source for a liquid crystal display (LCD) panel. In general, the higher the emission duty, the higher the brightness of output image. As for the image data mapping, the luminance may be enhanced for any image data by using a luminance enhancement curve such as the luminance enhancement curve C shown in FIG. 4.

Figure 7:
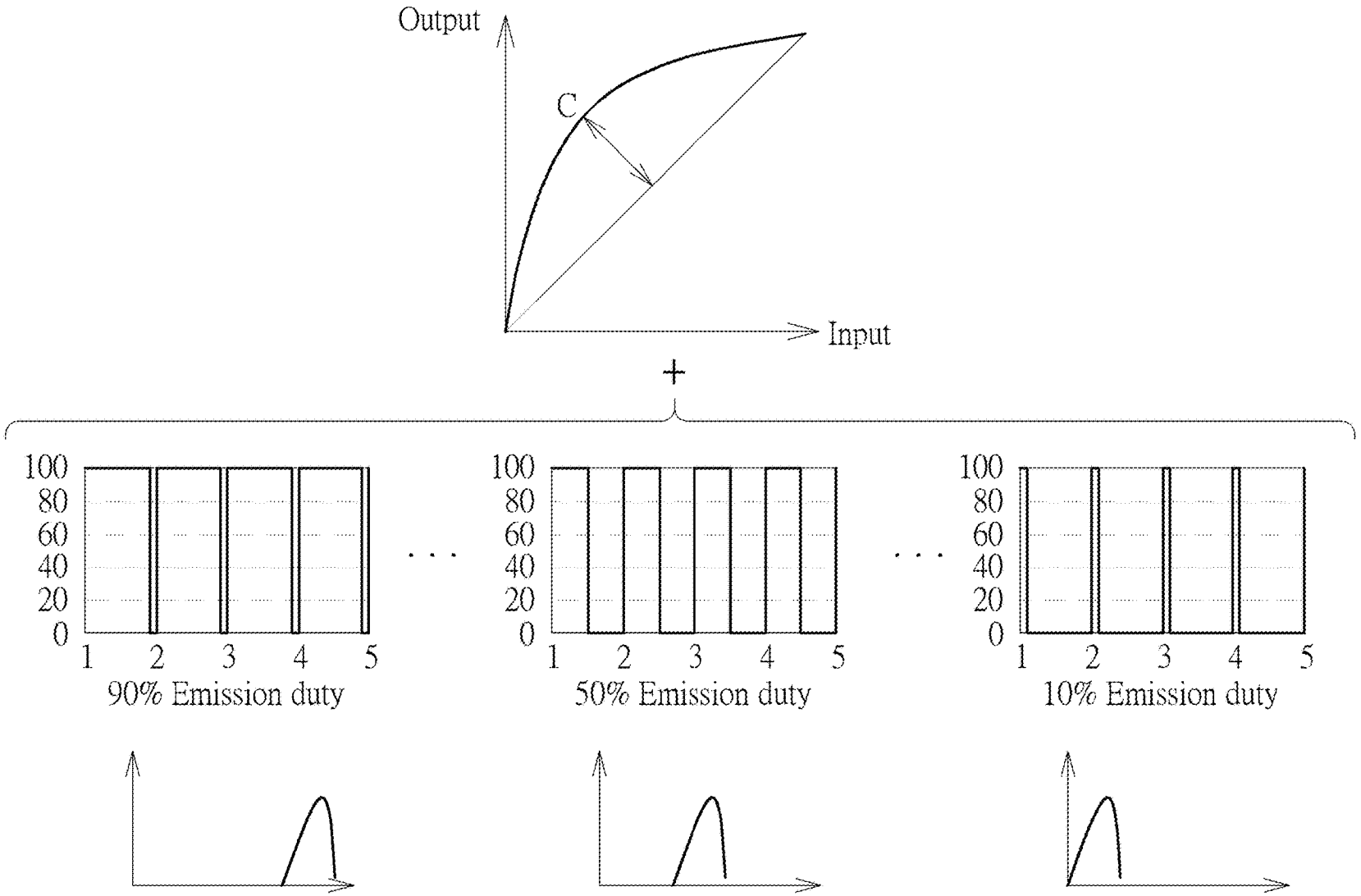
FIG. 7 is a schematic diagram of luminance control for power saving according to an embodiment of the present invention.

Please refer to FIG. 7, which is a schematic diagram of luminance control for power saving according to an embodiment of the present invention. As shown in FIG. 7, the power saving unit 314 may control the luminance enhancement curve C and also control the emission duty to achieve a desired output luminance value while limiting the power consumption to a preferable level. Note that a large proportion of power consumption of a display system comes from the operations of light emission, such as the emission of OLED or the backlight of LCD. Therefore, considering the power consumption issue, the power saving unit 314 may control the emission duty to be as lower as possible, while enhancing the luminance enhancement curve C to generate proper output luminance, in order to achieve desired luminance values and also achieve power saving.

In an embodiment, when the histogram distribution indicates lower luminance in the input image, the emission duty may be configured to have a lower value (e.g., 10% as shown in FIG. 7), while the luminance enhancement curve C is controlled to achieve preferable luminance enhancement. When the histogram distribution indicates higher luminance in the input image, the emission duty may be forced to have a higher value (e.g., 90% as shown in FIG. 7) so that the luminance enhancement curve C can be well controlled. When the histogram distribution indicates medium luminance in the input image, the emission duty may be configured to have a medium value (e.g., 50% as shown in FIG. 7). In general, it is preferable to decrease the emission duty while increasing the luminance enhancement curve C to achieve identical output luminance and visual effects, and the decreased emission duty may lead to less power consumption.

In another aspect, the pixel degradation protection unit 316 of the image processor 304 aims at pixel protection. Those skilled in the art understand that long-term display of the same image in specific pixels may generate image burn-in or ghost image, especially on an OLED panel. Therefore, a compensation scheme or a protection scheme for pixel degradation is provided.

Figure 8:
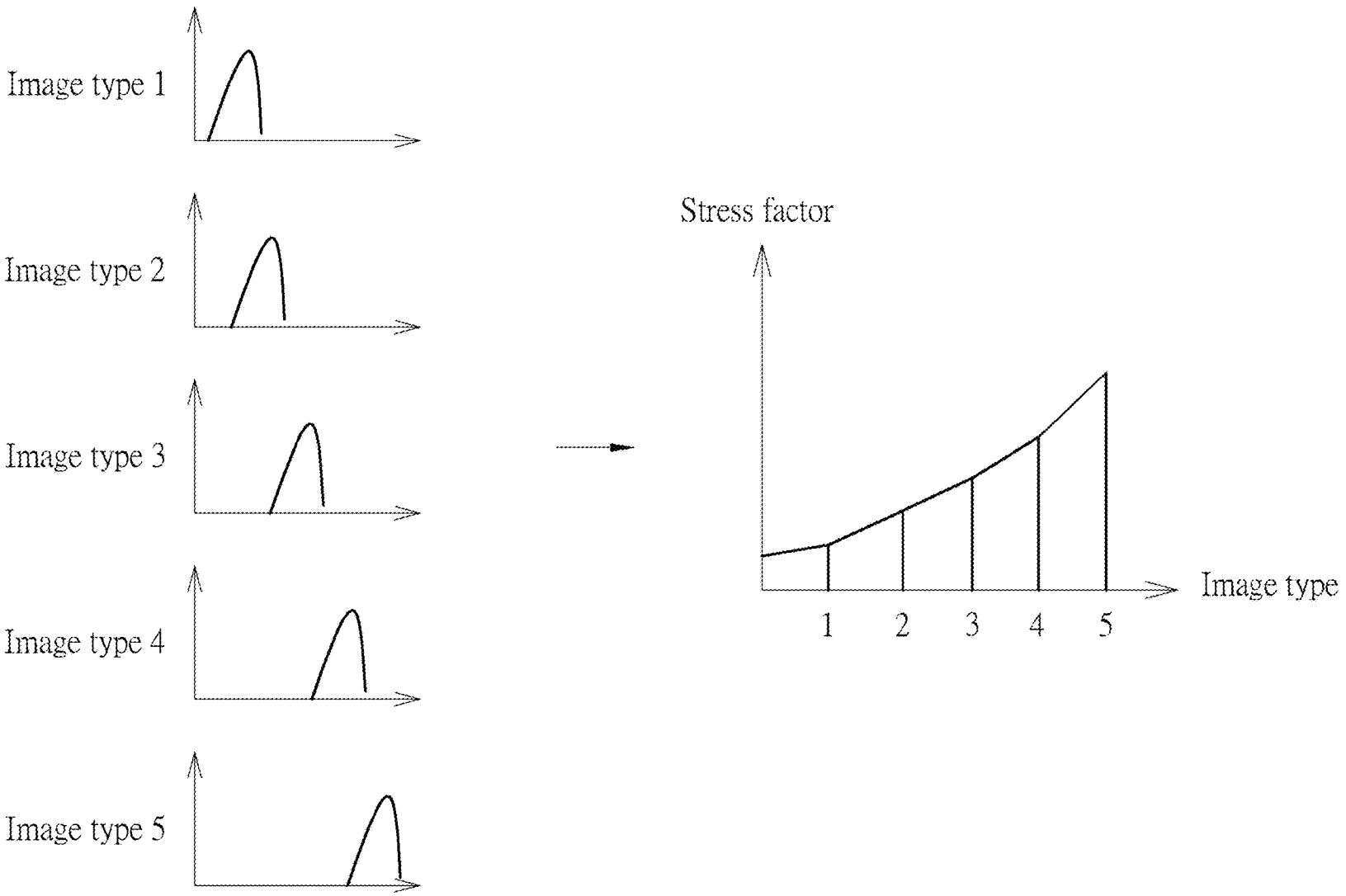
FIG. 8 is a schematic diagram of luminance control for pixel degradation protection according to an embodiment of the present invention.

Please refer to FIG. 8, which is a schematic diagram of luminance control for pixel degradation protection according to an embodiment of the present invention. As shown in FIG. 8, the pixel degradation protection unit 316 may determine or obtain a stress factor of an input image frame, and thus decrease the luminance of displaying the image frame when the stress factor indicates that the image content of the image frame may generate pixel degradation and/or image burn-in on the panel. In general, an image frame or pixel having higher brightness may be more harmful to the panel; hence, according to the histogram distribution of input image frame, the pixel degradation protection unit 316 may know that the input image frame has high luminance or low luminance, and thereby classify the image into a specific image type. Accordingly, a stress factor may be assigned to the image frame based on the image type. More specifically, if the image frame is brighter, the pixel degradation protection unit 316 may determine that the image frame may generate severe burn-in on the panel, and thereby assigns a higher stress factor to the image frame. The higher stress factor indicates that the image luminance should be decreased by a greater level in order to mitigate the image burn-in problem. This prevents that the panel continuously shows an image having high brightness to cause image burn-in easily. If the stress factor is adjusted appropriately, the degradation of visual effects may be minimized.

In another embodiment, the stress factor is configured to control the idle time configuration of the panel. In general, the screen of a mobile phone is usually configured to get dark when no user input is detected for a time period. The stress factor may be used to control the time of getting dark. For example, if a high brightness image that may generate severe image burn-in is displayed, the stress factor may be larger; hence, the time period for detecting any user input may be shortened, i.e., the screen may get dark earlier to reduce the continuous time for showing the high brightness image, so as to mitigate the image burn-in problem and increase the lifespan of the panel.

Figure 9:
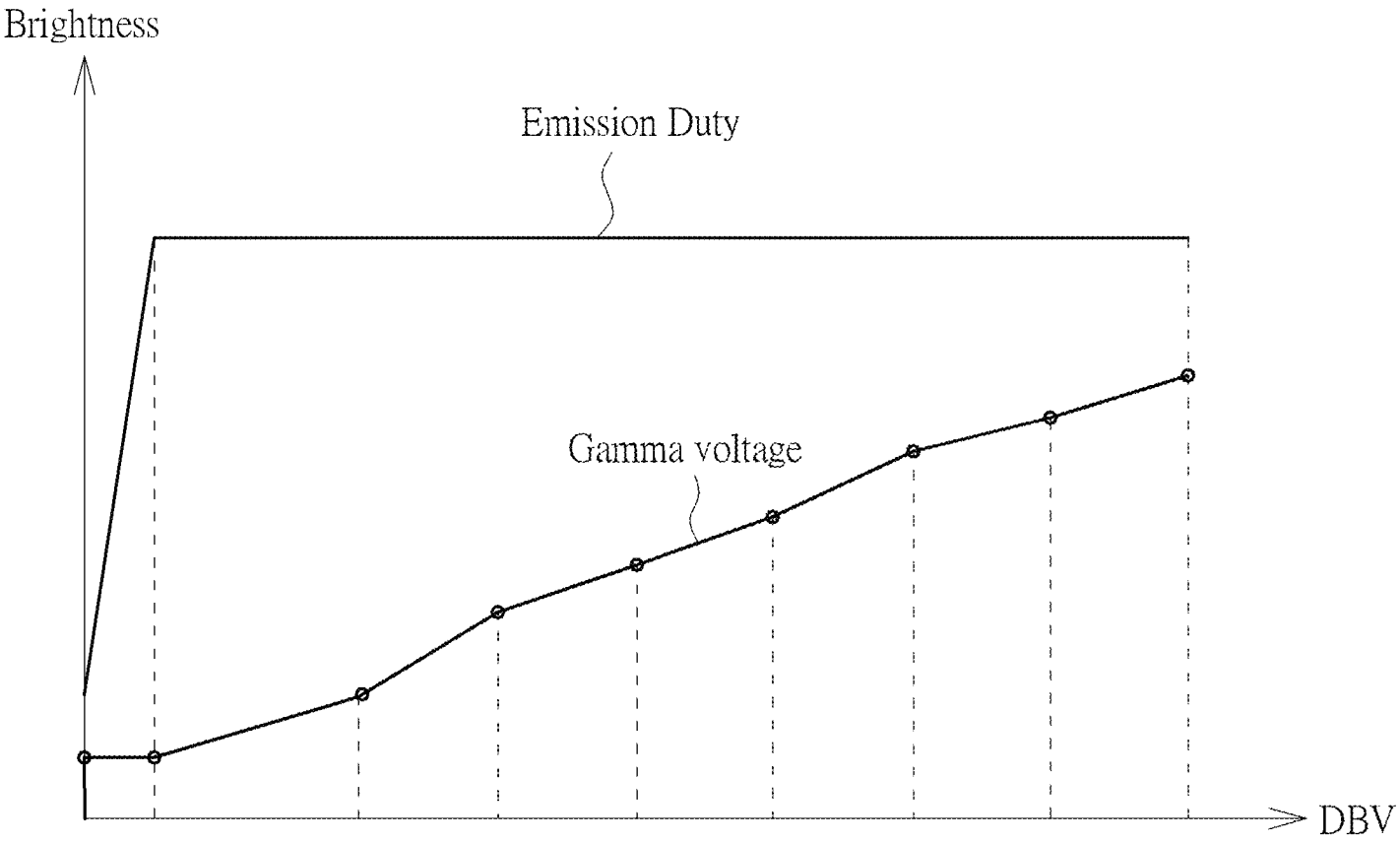
FIG. 9 is a schematic diagram of an exemplary implementation of controlling the panel brightness.

According to the processing of the image optimization unit 312, the power saving unit 314 and the pixel degradation protection unit 316 as mentioned above, the image processor 304 in the image control system 30 may control or adjust the panel brightness by controlling the emission duty and output gamma voltage. FIG. 9 illustrates an exemplary implementation of controlling the panel brightness, where the horizontal axis is a display brightness value (DBV) and the vertical axis indicates the values of the emission duty and the output gamma voltage. As mentioned above, the emission duty refers to the ratio of emission time in a cycle. The output gamma voltage refers to the output voltage outputted from the driver circuit to the panel. The DBV refers to possible brightness levels as an index for controlling the emission duty and the gamma voltage. For a larger DBV, the image processor 304 may increase the emission duty and/or increase the output gamma voltage to realize higher brightness. In other words, the image processor 304 may control both the emission duty and the output gamma voltage to reach the desired brightness. Note that the configuration of emission duty and gamma voltage shown in FIG. 9 is one of various implementations of the present invention, those skilled in the art should understand that each brightness may be realized with any possible combination of emission duty setting and gamma voltage setting.

Figure 10:
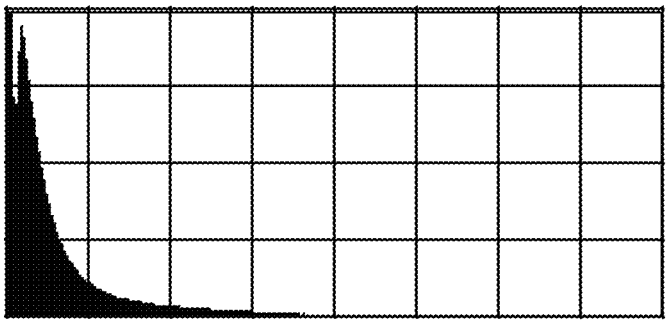
FIG. 10 is a schematic diagram of analyzing the histogram to obtain the feature of the image data.

As mentioned above, the image processor 304 may control the parameter(s) for displaying the image frame according to the image data distribution such as a histogram distribution. The image data distribution may be analyzed to realize the control schemes by any method. Please refer to FIG. 10, which is a schematic diagram of analyzing the histogram to obtain the feature of the image data. FIG. 10 illustrates a histogram distribution where the right-hand side records brighter image and the left-hand side records darker image, and the height is the pixel count for each brightness value. As shown in FIG. 10, the pixel data in this image frame are mostly concentrated on low brightness part. In order to extract the feature of image data, the histogram is divided as an M×N block. In this embodiment, M=8 and N=4. Accordingly, a 2-dimensional feature profile corresponding to the M×N block is generated, where the blocks in which pixel count is higher than a threshold are marked as "1", and other blocks are marked as "0". In order to facilitate processing of the feature profile, the 2-dimensional feature profile may further be converted into a 1-dimensional feature profile, which may be a vector (Profile[8]) as shown in FIG. 10.

As a result, the histogram distribution of pixel data may be digitalized, i.e., converted into digital data to be analyzed and determined easily. For example, if an image frame includes 2000×2000 pixels, the great number of pixel data may be simplified to be a feature profile having M×N-bit data, which is 8×4-bit data in this example. The information recorded in the 1-dimensional feature profile may be used as a reference, to control the abovementioned parameters for luminance enhancement, power saving control, and panel protection.

Subsequently, according to the feature profile, the image processor 304 may perform classification on the image frame. In an embodiment, there are a plurality of template profiles. The template profiles are preconfigured and each template profile corresponds to a parameter setting. The image frame may be classified into one of the template profiles according to the feature profile, to determine which parameter setting should be applied. The classification may be realized by comparing the feature profile of the image frame with each of the template profiles to find the similarity between the feature profile and the template profiles. The image frame may be classified into a first template profile if the similarity of the feature profile and the first template profile is higher than the similarity of the feature profile and any other template profile.

For example, each template profile may be in the form of a vector including M×N-bit data, as corresponding to the feature profile obtained from the histogram distribution of image data. The similarity may be obtained by performing exclusive-or operation on each corresponding bit between the template profile and the feature profile. If the two bits are identical, the exclusive-or operation will output "0". Subsequently, the zero counts are summed to generate a score which indicates the similarity of the feature profile and the template profile; hence, the template profile having the highest score may be selected. Alternatively, the score may be calculated by summing the exclusive-or results, so that more "0" and less "1" indicate high similarity.

In an embodiment, the parameter setting of each image frame may be performed with a hysteresis scheme. The hysteresis prevents two consecutive image frames from being configured with two faraway settings, especially on luminance adjustment. It is preferable to perform luminance adjustment gradually, to avoid flickers on the image due to parameter adjustments.

Please note that the present invention aims at providing a method of controlling image data and a related image control system which are capable of controlling and processing image data to achieve higher image quality, lower power consumption, and higher product lifespan of panel. Those skilled in the art may make modifications and alternations accordingly. For example, in the above embodiments, pixel data of an image frame may be gathered to generate a histogram distribution, to determine display parameters for the image frame. In another embodiment, a histogram distribution may include pixel data of two or more consecutive image frames or a half of image frame, and the parameter setting may be performed on two or more consecutive image frames or a half of image frame based on the histogram distribution.

Figure 11:
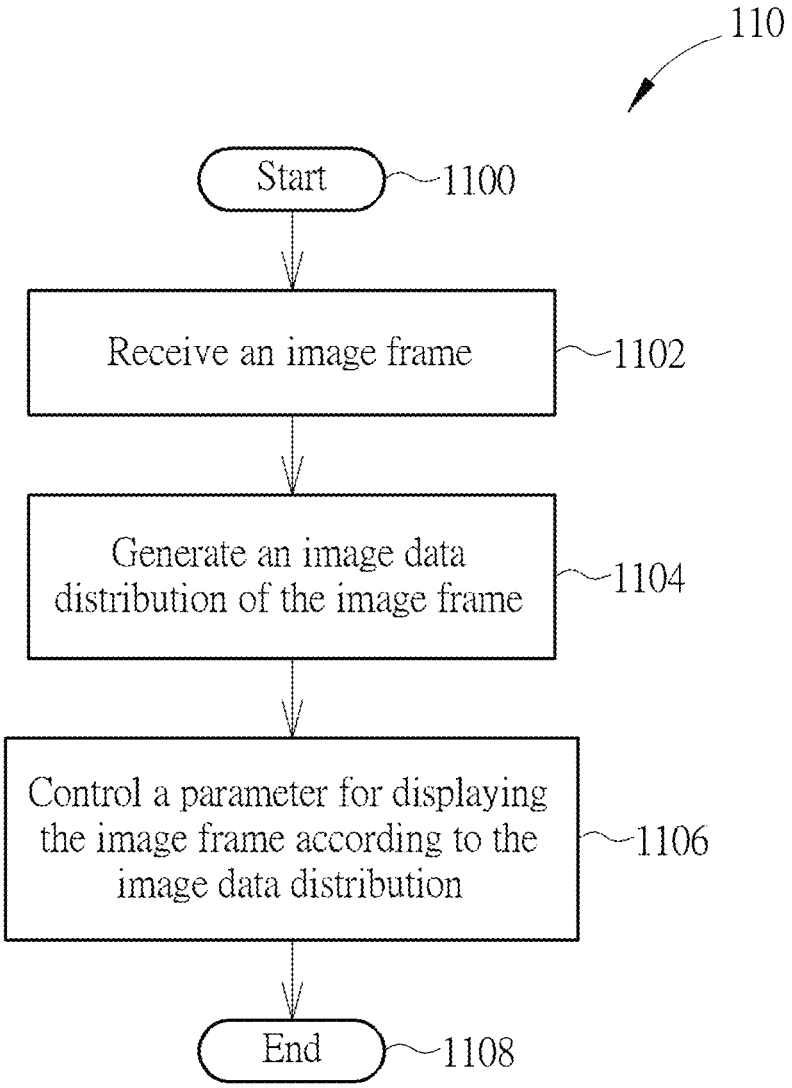
FIG. 11 is a schematic diagram of an image data control process according to an embodiment of the present invention.

The abovementioned image data control method may be summarized into an image data control process 110, as shown in FIG. 11. The image data control process 110 may be realized in an image control system such as the image control system 30 shown in FIG. 3, for processing and controlling image data based on the histogram distribution of the image data. The image data control process 110 includes the following steps:

Step 1100: Start.

Step 1102: Receive an image frame.

Step 1104: Generate an image data distribution of the image frame.

Step 1106: Control a parameter for displaying the image frame according to the image data distribution.

Step 1108: End.

The detailed implementations and alternations of the image data control process 110 are recited in the above paragraphs, and will not be narrated herein.

To sum up, the present invention provides a method of controlling image data and a related image control system for a panel, especially an OLED panel. The image control system may be a driver circuit or a driver IC capable of outputting image data to the panel and driving the panel to display. In the driver circuit, the received image frame may be analyzed to generate a histogram distribution corresponding to image feature. The driver circuit may thereby process the image data according to the histogram distribution. In an embodiment, luminance enhancement, contrast adjustment, and/or color enhancement may be performed based on the feature of the image according to the histogram distribution, in order to optimize the visual effects of the output image. Alternatively or additionally, the luminance of image data may be controlled or adjusted to achieve power saving, and/or to provide better pixel protection by preventing image burn-in. The desired brightness of output image may be generated by configuring the emission duty and output gamma voltage, which may be easily realized in the driver circuit. In an embodiment, the histogram distribution may be analyzed by finding the corresponding feature profile of the histogram distribution and comparing the feature profile with a plurality of template profiles. Therefore, the image frame may be classified into a specific type of template profile, to be configured with a corresponding parameter setting corresponding to the template profile. As a result, the image control scheme may be realized in the driver circuit.

Those skilled in the art will readily observe that numerous modifications and alterations of the device and method may be made while retaining the teachings of the invention. Accordingly, the above disclosure should be construed as limited only by the metes and bounds of the appended claims.

What is claimed is:

1. A method of controlling image data, comprising:

receiving an image frame;

generating an image data distribution of the image frame; and controlling a parameter for displaying the image frame according to the image data distribution;

wherein the step of controlling the parameter for displaying the image frame according to the image data distribution comprises:

generating a feature profile corresponding to the image data distribution of the image frame; and controlling the parameter for displaying the image frame according to the feature profile.

2. The method of claim 1, wherein the image data distribution is a histogram distribution of luminance of pixel data in the image frame.

3. The method of claim 1, wherein the parameter comprises at least one of a luminance enhancement parameter, a contrast adjustment parameter, and a color enhancement parameter.

4. The method of claim 1, wherein the step of controlling the parameter for displaying the image frame according to the image data distribution comprises:

controlling an emission duty of displaying the image frame according to the image data distribution.

5. The method of claim 1, wherein the step of controlling the parameter for displaying the image frame according to the image data distribution comprises:

decreasing a luminance for displaying the image frame when a stress factor of the image frame indicates that image content of the image frame generates degradation on a panel displaying the image frame.

6. The method of claim 1, wherein the step of controlling the parameter for displaying the image frame according to the image data distribution comprises:

controlling an emission duty of displaying the image frame and an output gamma voltage according to a display brightness value.

7. The method of claim 1, wherein the step of controlling the parameter for displaying the image frame according to the feature profile comprises:

classifying the image frame into a template profile according to the feature profile of the image frame; and controlling the parameter for displaying the image frame according to the template profile into which the image frame is classified.

8. The method of claim 7, wherein the step of classifying the image frame into the template profile according to the feature profile of the image frame comprises:

comparing the feature profile of the image frame with each of a plurality of template profiles, respectively, to generate a plurality of comparison results; and selecting one of the plurality of template profiles as the template profile into which the image frame is classified when the plurality of comparison results indicate that a similarity of the feature profile and the template profile is higher than a similarity of the feature profile and any other template profile among the plurality of template profiles.

9. The method of claim 1, wherein the image frame is configured to be displayed on an organic light-emitting diode (OLED) panel.

10. An image control system, comprising:

an image detector, configured to receive an image frame and generate an image data distribution of the image frame; and an image processor, coupled to the image detector, configured to control a parameter for displaying the image frame according to the image data distribution;

wherein the image processor is configured to perform the following steps to control the parameter for displaying the image frame according to the image data distribution:

generating a feature profile corresponding to the image data distribution of the image frame; and controlling the parameter for displaying the image frame according to the feature profile.

11. The image control system of claim 10, wherein the image data distribution is a histogram distribution of luminance of pixel data in the image frame.

12. The image control system of claim 10, wherein the parameter comprises at least one of a luminance enhancement parameter, a contrast adjustment parameter, and a color enhancement parameter.

13. The image control system of claim 10, wherein the image processor is configured to control an emission duty of displaying the image frame according to the image data distribution.

14. The image control system of claim 10, wherein the image processor is configured to decrease a luminance for displaying the image frame when a stress factor of the image frame indicates that image content of the image frame generates degradation on a panel displaying the image frame.

15. The image control system of claim 10, wherein the image processor is configured to control an emission duty of displaying the image frame and an output gamma voltage according to a display brightness value.

16. The image control system of claim 10, wherein the image processor is configured to perform the following steps to control the parameter for displaying the image frame according to the feature profile:

classifying the image frame into a template profile according to the feature profile of the image frame; and controlling the parameter for displaying the image frame according to the template profile into which the image frame is classified.

17. The image control system of claim 16, wherein the image processor is configured to perform the following steps to classify the image frame into the template profile according to the feature profile of the image frame:

comparing the feature profile of the image frame with each of a plurality of template profiles, respectively, to generate a plurality of comparison results; and selecting one of the plurality of template profiles as the template profile into which the image frame is classified when the plurality of comparison results indicate that a similarity of the feature profile and the template profile is higher than a similarity of the feature profile and any other template profile among the plurality of template profiles.

18. The image control system of claim 10, wherein the image frame is configured to be displayed on an organic light-emitting diode (OLED) panel.

* * * * *